US006671489B2

(12) United States Patent
Natsuhara et al.

(10) Patent No.: US 6,671,489 B2
(45) Date of Patent: Dec. 30, 2003

(54) THERMAL FIXING APPARATUS

(75) Inventors: Masuhiro Natsuhara, Itami (JP); Hirohiko Nakata, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/169,129

(22) PCT Filed: Oct. 19, 2001

(86) PCT No.: PCT/JP01/09229

§ 371 (c)(1),
(2), (4) Date: Jun. 27, 2002

(87) PCT Pub. No.: WO02/37191

PCT Pub. Date: May 10, 2002

(65) Prior Publication Data

US 2003/0042240 A1 Mar. 6, 2003

(30) Foreign Application Priority Data

Nov. 1, 2000 (JP) ..... 2000-334511

(51) Int. Cl.[7] ..... G03G 15/20; H05B 1/00
(52) U.S. Cl. ..... 399/329; 219/216; 399/335
(58) Field of Search ..... 399/329, 335, 399/338, 330; 219/216

(56) References Cited

U.S. PATENT DOCUMENTS

| | | | | |
|---|---|---|---|---|
| 5,499,087 A | * | 3/1996 | Hiraoka et al. | 219/216 X |
| 5,860,052 A | * | 1/1999 | Ohtsuka et al. | 399/329 |
| 5,874,710 A | * | 2/1999 | Yoshimoto et al. | 399/329 X |
| 5,920,757 A | * | 7/1999 | Izawa et al. | 399/329 |
| 5,939,337 A | | 8/1999 | Hatakeyama et al. | 399/335 X |
| 6,122,478 A | * | 9/2000 | Hirst | 399/330 |
| 6,339,211 B1 | * | 1/2002 | Foote et al. | 219/216 |
| 6,384,378 B2 | | 5/2002 | Natsuhara et al. | 219/216 |
| 6,518,546 B2 | * | 2/2003 | Otsuka et al. | 219/216 |

FOREIGN PATENT DOCUMENTS

| | | |
|---|---|---|
| JP | 63-313182 | 12/1988 |
| JP | 1-263679 | 10/1989 |
| JP | 2-157878 | 6/1990 |
| JP | 4-372974 | 12/1992 |
| JP | 5-241471 | 9/1993 |
| JP | 5-241471 | 11/1993 |
| JP | 6-337602 | 12/1994 |
| JP | 8-30126 | 2/1996 |
| JP | 9-80940 | 3/1997 |
| JP | 9-197861 | 7/1997 |
| JP | 2002-31972 | 1/2002 |
| JP | 2002-31976 | 1/2002 |

* cited by examiner

*Primary Examiner*—Fred L Braun
(74) *Attorney, Agent, or Firm*—McDermott, Will & Emery

(57) ABSTRACT

In a heating-type toner-fixing unit using a ceramic heater and a cylindrical fixing film, the shape of the fixing face-side surface of a ceramic heater 10 which comes into contact with a fixing film 3 and the shape of the portions of a heater support 12 at least adjacent to the fixing face-side surface are formed into a shape that is almost identical to a naturally deformed shape of the fixing film 3 in a static state or a traveling state where the fixing film is pressed by a pressure roller 4 at a designated nip width. It is also possible that the nip portion and portions adjacent thereto at the entrance side and exit side are formed into a flat shape and portions other than the flat portions are formed into a curved surface shape along the cylindrical shape of the fixing film 3.

18 Claims, 6 Drawing Sheets

THERMAL FIXING APPARATUS

TECHNICAL FIELD

The present invention relates to a heating-type toner-fixing unit to be used in an image forming machine such as a fax machine, a copying machine, a printer and the like.

BACKGROUND ART

Formerly, in heating-type toner-fixing units used in image forming machines such as fax machines, copying machines, printers and the like, after a toner image formed on a photosensitive drum is transferred onto a sheet of paper or the like as a recording material, the toner image is fixed on the sheet surface by heating and pressing by the toner-fixing unit. These toner-fixing units comprise a heating roller and a resin pressure roller, and of these, the heating roller employs a system where a cylindrical metal roller is provided therein with a heat source such as a halogen lamp or the like and the surface region of the metal roller is heated by the heat of the heat source so as to fix the toner.

In recent years, a heating-type toner-fixing unit using a ceramic heater has been proposed for this fixing system, and put into practical use. This method has been disclosed in Japanese Unexamined Patent Publication No. Hei-1-263679, Japanese Unexamined Patent Publication No. Hei-2-157878, and Japanese Unexamined Patent Publication No. Sho-63-313182, for example. Specifically, a ceramic heater is attached to a resin heater support, furthermore, a heat-resistant fixing film revolves around the periphery thereof at a speed almost the same as that of a pressure roller to feed a sheet of paper, and heat of the ceramic heater is transferred via the fixing film to the toner and the sheet of paper. In this method, there are advantages such that, since heat capacity of the ceramic heater as a heating element is significantly smaller than that of the former metal roller, power consumption can be reduced and moreover, since preheating of the heater after power is supplied thereto is unnecessary, the quick-start property is excellent. Currently, as a base material of the ceramic heater, alumina ($Al_2O_3$) is generally used.

A further detail is described here based on FIG. 1 and FIG. 2, which conceptually show this fixing method. A ceramic heater 1 is attached to a heater support 2, around the periphery of which a cylindrical heat-resistant fixing film 3 is movably disposed, and a pressure roller 4 synchronously rotates while pressing the fixing film 3 against the ceramic heater 1. The fixing film 3 which is pressed against the ceramic heater 1 by the pressure roller 4 forms a nip portion having a nip width of N between the ceramic heater 1 and the pressure roller 4 as a result of the peripheral deformation of the pressure roller 4 as shown in FIG. 2 in an enlarged manner. A recording material 5 such as a sheet of paper on which a toner image 6*a* is formed is inserted between the rotating fixing film 3 and pressure roller 4, and the toner image 6*a* is heated and pressed at the nip portion and fixed as an image 6*b* on the recording material 5.

In addition, the ceramic heater 1 has, for example, a structure as shown in FIG. 3. Namely, one or a plurality of heating elements 1*b* and current-conducting electrode(s) 1*c* for conducting current to these heating elements 1*b* are provided on a ceramic base plate 1*a*, and an overcoat glass layer 1*d* for protection and for securing insulation is formed on the heating elements 1*b*. This ceramic base plate 1*a* generally has a thin rectangular flat-plate shape as a whole, and the heating elements 1*b* are formed on a fixing face, or the back of the fixing face, where the ceramic base plate 1*a* comes into contact with the pressure roller 4 via the fixing film 3.

Recently, a higher fixing rate has also been demanded for this fixing method. In a conventional ceramic heater using an alumina base plate, the fixing rate is 4 to 16 ppm (4 ppm is a rate for feeding four pages of A4-size paper per minute), and furthermore, high-speed processing at 24 ppm or more has been demanded.

However, the above case of a ceramic heater using an alumina base plate is disadvantageous in terms of base plate fractures caused by thermal shock during rapid heating. Namely, a voltage of 100V or 200V is applied to one or both ends of the heating elements of the ceramic heater to generate Joule heat of several hundreds of watts or more, thereby rapidly raising the temperature to approximately 200° C. in approximately 2 to 6 seconds, and therefore, the alumina base fractures. In addition, when the fixing rate is increased, the time needed to transfer heat from the heater to each sheet of paper is shortened. Since a certain amount of heat is necessary to fix the toner, however, a greater amount of heat must be supplied from the heater to the sheet per unit time. As a result, the thermal shock to be applied to the heater tends to be increased, thus increasing the probability of ceramic base plate fracture.

Therefore, ceramic heaters using aluminum nitride (AlN) excellent in thermal shock resistance have been disclosed in Japanese Unexamined Patent Publication No. Hei-9-80940 and Japanese Unexamined Patent Publication No. Hei-9-197861. According to the descriptions of Japanese Unexamined Patent Publication No. Hei-9-80940, by exploiting the fact that aluminum nitride has a higher thermal conductivity than that of aluimina, temperature responsivity of the heater is improved. According to the heater described in Japanese Unexamined Patent Publication No. Hei-9-197861, by utilizing the high thermal conductivity of aluminum nitride, an improvement in the fixing quality and high-speed printing is realized and power consumption is reduced.

For realization of a higher fixing rate, a problem has been pointed out in terms of not only the material (thermal conductivity and thermal expansion coefficient) of the ceramic heater as a heat source as in the above but also the shape thereof. Namely, as the fixing rate increases, the inner circumferential surface of the fixing film, which revolves at a high speed, is abraded due to friction between the ceramic heater and heater support and due to abrasion powder, lubricity of a lubricant such as grease which is applied to the fixing film and the ceramic heater thereof is lost, thereby disabling revolution of the fixing film.

In respect of this problem, an improvement has been attained as a result of investigations of the inventors, et al. of the present invention, by forming a curved surface on the ceramic heater, for which patent applications were already filed as Japanese Patent Application No. 2000-136621, Japanese Patent Application No. 2000-239280, and Japanese Patent Application No. 2000-239281. A higher rate and further improvement in durability of the fixing film have been demanded

DISCLOSURE OF THE INVENTION

In light of such prior circumstances, it is an object of the present invention to provide a heating-type toner-fixing unit which can still further improve durability of a fixing film and also further improve fixing quality during high-rate fixing at 24 ppm or more.

In order to achieve the above object, a first aspect of the present invention provides a heating-type toner-fixing unit in which a cylindrical heat-resistant fixing film is pressed against a heating member by means of a pressure member to form a nip portion between the fixing film and heating member whereby fixing is carried out by heating a recording material carrying an unfixed toner image while nipping and feeding this recording material, wherein the shape of the fixing face-side surface of a ceramic heater as the heating member which comes into contact with the fixing film and the shape of portions of a heater support at least adjacent to the fixing face-side surface are formed into a shape that is almost identical to a naturally deformed shape of the fixing film in a static state where the fixing film is pressed at a designated nip width against the heating member by the pressure member.

In addition, a second aspect of the present invention provides a heating-type toner-fixing unit in which a cylindrical heat-resistant fixing film is pressed against a heating member by means of a pressure member to form a nip portion between the fixing film and heating member and fixing is carried out by heating a recording material carrying an unfixed toner image while nipping and feeding this recording material, wherein the shape of the fixing face-side surface of a ceramic beater as the heating member which comes into contact with the fixing film and the shape of portions of a heater support at least adjacent to the fixing face-side surface are formed into a shape that is almost identical to a naturally deformed shape of the fixing film in a traveling state where the fixing film is pressed against the heating member by the pressure member at a designated nip width so as to travel.

In the heating-type toner-fixing unit according to the above first and second aspects of the present invention, the shape of the fixing face-side surface of the ceramic heater which comes into contact with a fixing film of the ceramic heater and the shape of portions of the heater support at least adjacent to the fixing face-side surface are formed into a curved surface which is generally convex or concave with respect to the pressure member. In addition, the shape of the fixing face-side surface of the ceramic heater which comes into contact with a fixing film and the shape of portions of the heater support at least adjacent to the fixing face-side surface can be, from the entrance of the nip portion to the center of the nip portion, a shape which is almost identical to a naturally deformed shape of the fixing film in a static state or a traveling state where the fixing film is pressed against the heating member by the pressure member and, from the center of the nip portion to the exit of the nip portion, a flat shape.

Furthermore, a third aspect of the present invention provides a heating-type toner-fixing unit in which a cylindrical heat-resistant fixing film is pressed against a heating member by means of a pressure member to form a nip portion between the fixing film and heating member and fixing is carried out by heating a recording material carrying an unfixed toner image while nipping and feeding this recording material, wherein the shape of the fixing face-side surface of a ceramic heater as the heating member which comes into contact with the fixing film and the shape of portions of a heater support at least adjacent to the fixing face-side surface are, at the nip portion and at the entrance side and exit side adjacent to the nip portion, formed into a flat shape parallel to the nip portion, and at other portions, are formed into a shape along the cylindrical shape of the fixing film.

In the heating-type toner-fixing unit according to the above first through third aspects of the present invention, the main constituent of the ceramic heater is aluminum nitride or silicon nitride.

BEST MODE FOR CARRYING OUT THE INVENTION

According to a heating-type toner-fixing unit of the present invention, in a fixing method using a cylindrical fixing film and a ceramic heater, not only the shape of a ceramic heater as a heating member but also the shape of the heater support for holding the ceramic heater are made approximately identical to a naturally deformed shape of the fixing film in a static state where the fixing film is pressed against the heating member by a pressure member or made approximately identical to a naturally deformed shape of the fixing film in a traveling state where the fixing film is made to travel.

A heat-resistant fixing film made of a resin or a metal is used as the cylindrical fixing film used in the present invention. A resin fixing film is usually made of a heat-resistant resin having rigidity such as polyimide and has a thickness on the order of 10 to 100 $\mu$m. A metal fixing film has thermal conductivity higher than that of a heat-resistant resin and can obtain satisfactory fixing quality even with a small nip width, therefore, providing a better high-rate fixing quality than a heat-resistant resin film. As a material of such a metal fixing film, stainless steel, nickel or the like can be used. In either case where the fixing film is made of a resin or a metal, a fluorocarbon resin is coated on the fixing face-side for preventing toner from adhering.

This fixing film is pressed against the heating member, that is, the ceramic heater, by the pressure means, that is, a pressure roller and revolves, at a speed approximately identical to that of the pressure roller rotation, around the periphery of a heater support to which the ceramic heater is attached. In general, the heater support is smaller than the inside diameter of the fixing film and, at some parts thereof, comes into contact with the fixing film, thereby forming an orbit of the fixing film. However, since this fixing film is usually made of a resin having rigidity such as polyimide or a metal, this film is deformed by the ceramic heater and heater support in the vicinity of the pressure roller.

Figure 1:
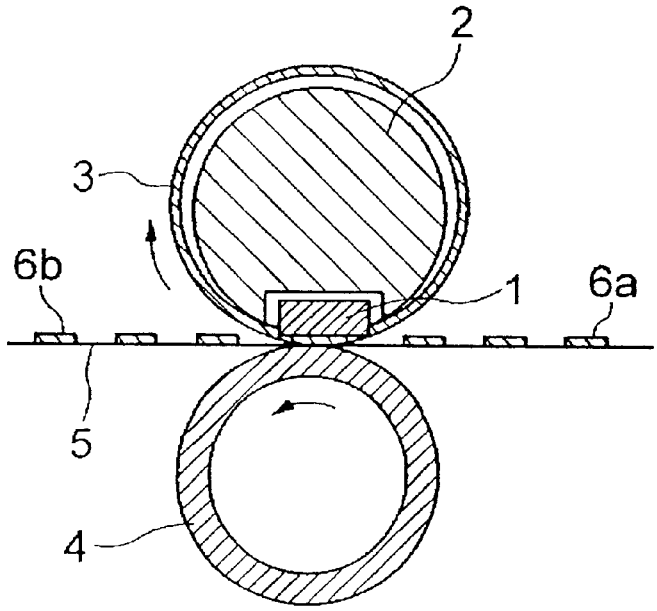
FIG. 1 Prior Art
FIG. 1 is a schematic sectional view conceptually showing a heating-type toner-fixing unit using a ceramic heater and a fixing film.
Figure 2:
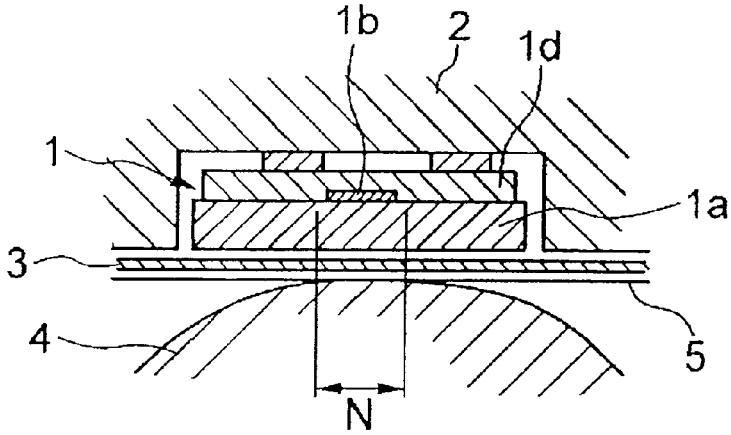
FIG. 2 Prior Art
FIG. 2 is a schematic sectional view for explaining a nip portion formed between a fixing film and a heating member of a heating-type toner-fixing unit.
Figure 3:
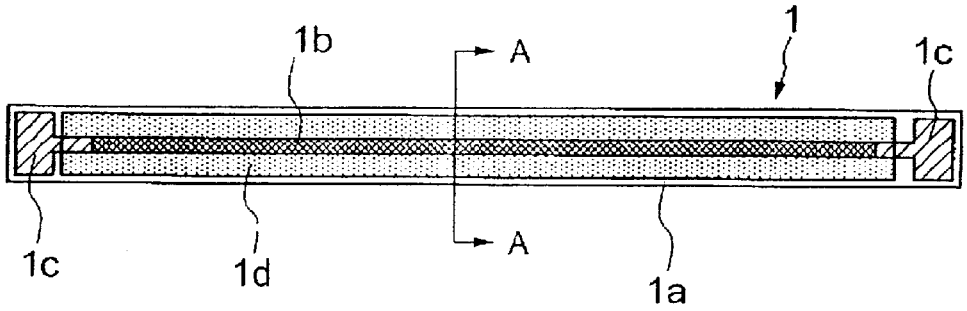
FIG. 3 (a) Prior Art
FIG. 3 shows views of a normal ceramic heater, wherein FIG. 3(*a*) is a plan view thereof and FIG. 3(*b*) is a sectional view thereof along line A—A.
Figure 3:
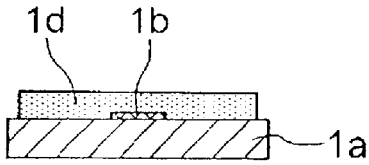
FIG. 3 (b) Prior Art
Figure 4:
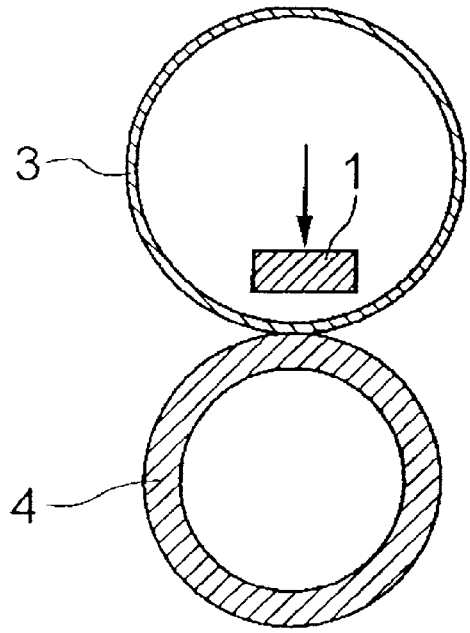
FIG. 4 Prior Art
FIG. 4 is a sectional view schematically showing the shape of a fixing film before a flat plate-shaped ceramic heater is pressed against a pressure roller.
Figure 5:
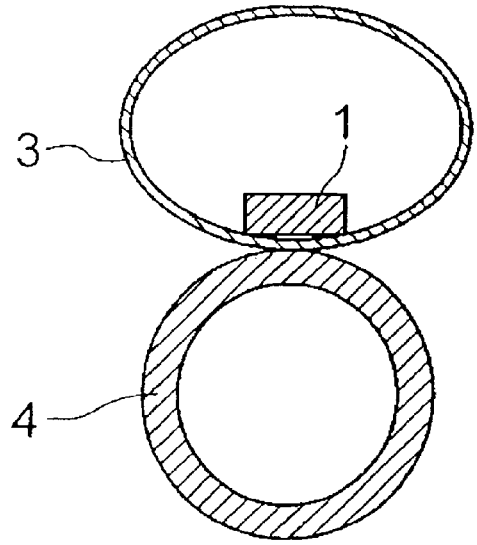
FIG. 5 Prior Art
FIG. 5 is a sectional view schematically showing a deformed shape of a fixing film in a static state where a flat plate-shaped ceramic heater is pressed against a pressure roller.

For example, as shown in FIG. 4 and FIG. 5, if the fixing face of the ceramic heater 1 for nipping the fixing film 3 with the pressure roller 4 is flat, the fixing film 3 which is pressed against the ceramic heater 1 by the pressure from the pressure roller 4 is forced to have a flat shape at a portion where the pressure roller 4 comes into contact with the ceramic heater 1. Therefore, the cylindrical fixing film 3 is deformed into an approximately elliptic shape as shown in FIG. 5.

However, since the current ceramic heater and heater support are of shapes where a shape of the deformed fixing film is not taken into consideration, the fixing film, when revolving at a high speed, comes into contact with a part of the ceramic heater and/or the heater support locally and intensively, causing friction at this part on the inner circumferential surface of the fixing film. Accordingly, powder that is generated by such friction adheres to the fixing film, whereby rotational quality of the fixing film decreases, and as a result, the fixing film stops revolution. In particular, in the case of a metal fixing film, not only does abrasion occur but also distortion easily occurs because of vulnerability to deformation, and there is also a risk of fracture.

Figure 6:
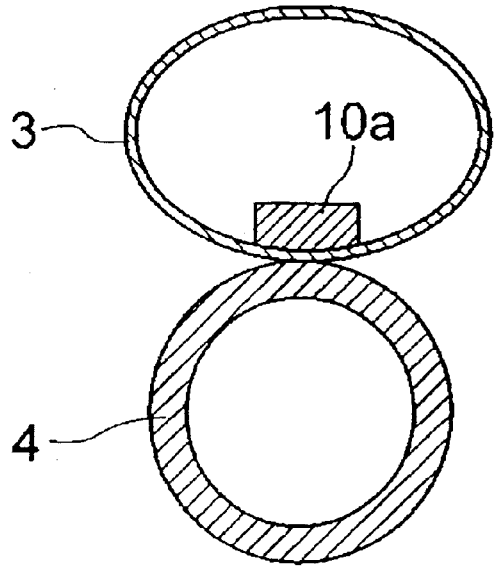
FIG. 6 shows views of one mode of the present invention, wherein FIG. 6(*a*) is a sectional view schematically showing a naturally deformed shape of a fixing film in a static state where a member having a shape along the deformed shape of the fixing film is pressed against a pressure roller and FIG. 6(*b*) is a sectional view schematically showing a ceramic heater and a heater support that are fabricated based on this state.
Figure 6:
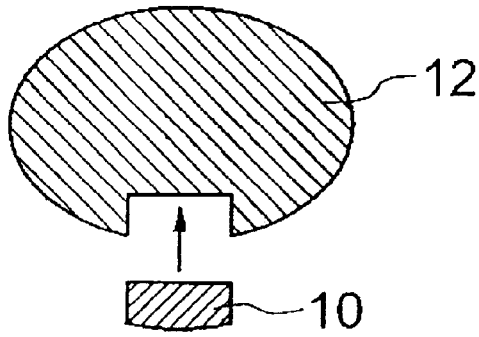

Therefore, in the present invention, in a case similar to the above where the nip width having a predetermined length is formed by the ceramic heater, the pressure roller, and the fixing film, as shown in FIG. 6(*a*), fixing film 3 is pressed against the pressure roller 4 by means of a member 10*a* having a shape assuming a heater shape and a nip width with which the fixing film 3 is deformed into an approximately elliptic shape, whereby the fixing film 3 is naturally deformed. As shown in FIG. 6(*b*), by fabricating a ceramic heater 10 and a heater support 12 having a shape approximately identical to the shape of the fixing film 3 thus naturally deformed, the shape of the fixing face-side surface of the ceramic heater 10 which comes into contact with the fixing film 3 and the shape of portions of the heater support 12 at least adjacent to this fixing face-side surface can be made into a shape which is approximately identical to the naturally deformed shape of the fixing film 3 in a static state where the fixing film 3 is pressed against the ceramic heater 1 by the pressure roller 4.

Figure 7:
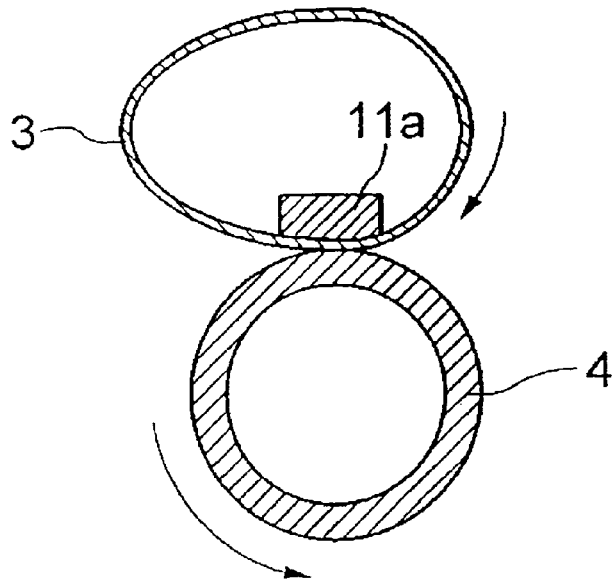
FIG. 7 shows views of another mode of the present invention, wherein FIG. 7(*a*) is a sectional view schematically showing a naturally deformed shape of a fixing film in a traveling state where a member having a shape along the deformed shape of the fixing film is pressed against a pressure roller and FIG. 7(*b*) is a sectional view schematically showing a ceramic heater and a heater support that are fabricated based on this state.
Figure 7:
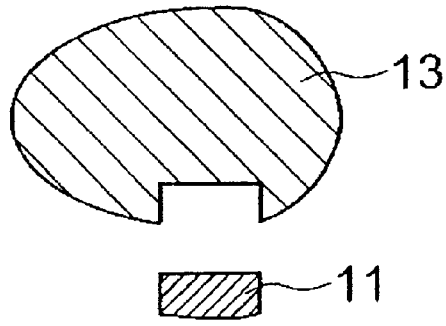

The above shapes of the ceramic heater and the heater support assume a state where the fixing film is static, that is, a state where the fixing film is not traveling; however, the same applies to the case where a traveling state is assumed. Namely, as shown in FIG. 7(*a*), the fixing film 3 is naturally deformed as a result of traveling while it is pressed against the pressure roller 4 by means of a member 11*a* having a shape formed based on an assumed shape of a heater and a nip width which would cause the fixing film 3 in a traveling state to be deformed into an elliptic shape close to an egg shape. Then, as shown in FIG. 7(*b*), by fabricating a ceramic heater 11 and a heater support 13 in a shape approximately identical to the shape of the fixing film 3 thus naturally deformed, the shape of the fixing face-side surface of the ceramic heater 11 which comes into contact with the fixing film 3 and the shape of portions of the heater support 13 at least adjacent to the fixing face-side surface can be made approximately identical to the naturally deformed shape of the fixing film 3 in a traveling state.

The aforementioned shape of the fixing face-side surface of the ceramic heater 11 which comes into contact with the fixing film 3 and the shape of portions of the heater support 13 at least adjacent to this fixing face-side surface normally form a curved surface which is generally convex with respect to the pressure roller. However, if the pressure force whereby the fixing film is pressed against the ceramic heater is increased, the fixing film deforms into a concave shape with respect to the pressure roller. In this case, it is necessary to form the shape of the fixing face-side surface of the ceramic heater that comes into contact with the fixing film and the shape of portions of the heater support at least adjacent to the fixing face-side surface into a concavely curved surface, which is reverse to the normal shape. In the case where a concavely curved surface is provided in this manner, since the fixing film is deformed into a shape along the ceramic heater, the nip width can be made greater with respect to the width of contact between the pressure roller and heater. Herein, in either case, it is preferable to make the connected shape of the ceramic heater and heater support to have a smoothly curved continuous surface, and in this case, as a matter of course, it is desirable that steps between the ceramic heater and heater support are as small as possible.

As described above, by forming the fixing face-side surface of the ceramic heater which comes into contact with the fixing film and portions of the heater support at least adjacent to the fixing face-side surface into a shape which is approximately identical to the naturally deformed shape of the fixing film in a static state or in a traveling state, the shape of the ceramic heater and heater support has a smoothly curved line following the naturally deformed shape of the fixing film. As a result, since the fixing film is prevented from locally and intensively coming into contact with the heater support and the ceramic heater, the life span of the fixing film can be improved even in a case where fixing is carried out at a high rate of 24 ppm or more over a long period of time.

In addition, if the shape of the ceramic heater and heater support is formed into a shape having a curved surface which is approximately identical to the naturally deformed shape of the fixing film, in particular, a curved surface which is concave with respect to the pressure roller, possible curling of a sheet of paper may occur after fixing depending on the fixing conditions. In this case, such paper sheet curls can be eliminated by forming the fixing face-side surface of the ceramic heater which comes into contact with the fixing film and portions of the heater support at least adjacent to the fixing face-side surface into a shape in which a portion from the entrance of the nip portion to the center of the nip portion is formed into a shape approximately identical to the naturally deformed shape of the fixing film and a portion from the center of the nip portion to the exit of the nip portion is formed into a flat shape.

Furthermore, in order to increase the nip width on the fixing face, it is advantageous, under an identical pressure roller and pressure force, that the shape of the heater has a flat face rather than a curved face that is convex with respect to the pressure roller. Therefore, in the case where the heater shape of the nip portion is made flat, it is preferable that the ceramic heater is formed such that the fixing film becomes parallel to the nip portion in front of and behind the nip portion of the ceramic heater as well so that excessive stress is not applied to the fixing film. Namely, as another mode of the present invention, the shape of the fixing face-side surface of the ceramic heater which comes into contact with the fixing film and the shape of portions of the heater support at least adjacent to this fixing face-side surface are formed into a flat shape parallel to the nip portion at the entrance side and exit side adjacent to this nip portion as well as at the nip portion, and, at other portions, into a shape along the cylindrical shape of the fixing film.

By employing such a mode, durability of the fixing film is improved, and at the same time, a large nip width can be securely formed to stabilize fixing quality. Namely, since the fixing film possesses its own radius of curvature and rigidity, if a plane surface is formed at a portion thereof, other portions are deformed to cancel the distortion caused thereby. If this deformed portion is formed in the neighborhood of the nip portion, the nip width is possibly reduced. Therefore, in order to prevent the formation of distortion in the neighborhood of the nip portion, the shape of the heater and/or the shape of the portions adjacent to the nip portion of the heater support are made parallel to the nip portion and portions other than the parallel portions are formed into a shape having a curved surface along the cylindrical shape of the fixing film, whereby the fixing film can enter and exit of the nip portion without receiving excessive stress, enabling to securely form a large nip width.

In addition, in the present invention, the fixing film may be of a heat-resistant resin or a metal. In particular, in the case of a metal fixing film, an improvement in the life span of the fixing film owing to the present invention is remarkable. This is because, since the deformability of metal as such is minimal, the metal fixing film, which is significantly deficient in deformation compared to a heat-resistant resin film, tends to be in a shape closer to a circular form as compared to a heat-resistant resin tube in a static state and a traveling state of the fixing film as described above, and consequently easily causes friction with the heater support or the like.

In addition, ceramics containing aluminum nitride (AlN) or silicon nitride ($Si_3N_4$) as a main constituent are desirable as a material of the ceramic heater to be used in the present invention. This is because these ceramics are excellent in thermal shock resistance and no cracks in the ceramics occur even if they are subjected to a rapid change in temperature during high-rate fixing at 24 ppm or more.

EXAMPLE 1

Aluminum nitride base plates and silicon nitride base plates with a flat plate shape of 300 mm×15 mm×1 mm were prepared as heater base plates. By screen printing, a belt-shaped heating element was printed with an Ag—Pd paste and current-conducting electrodes were printed with an Ag paste onto these base plates, which were then sintered at 870° C. in air. Thereafter, a glass paste was printed on the heating element excluding the current-conducting electrodes, and then sintered at 700° C. to form an overcoat glass layer, whereby flat plate-shaped ceramic heaters were fabricated.

Then, these flat plate-shaped ceramic heaters were set opposite to a pressure roller with a heat-resistant resin fixing film sandwiched therebetween such that a uniform pressure was applied, and were pressed until a designated nip width was obtained. In this static state, the deformed shape of the fixing film and the condition of contact of the fixing film to the ceramic heaters were confirmed, and as a result, the fixing film came into intensive contact with the edge portions of the ceramic heaters. Therefore, in order to eliminate the contact in the static state, the edge portions of the ceramic heaters were polished so as to curve smoothly. In this experiment, the shape of the fixing face of the ceramic heaters was an arc-shaped curved surface having a radius R=50 mm, which formed a convex shape with respect to the pressure roller. In addition, the same experiment as the above was performed by means of stainless steel and nickel fixing films, and as a result, the shape of the fixing face of the ceramic heaters at this time was an arc-shaped curved surface having a radius R=45 mm, which similarly formed a convex shape with respect to the pressure roller.

Figure 8:
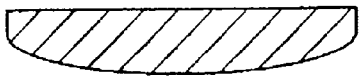
FIG. 8 shows schematic sectional views of ceramic heaters used in respective examples of the present invention, wherein FIG. 8(*a*) is a heater whose fixing face is convex and curved in an arc shape, FIG. 8(*b*) is a heater wherein the nip portion and its adjacent portions are flat and both sides thereof are curved, FIG. 8(*c*) is a heater whose fixing face is concave and curved in an arc shape, and FIG. 8(*d*) is a heater whose fixing face is concave and curved in an arch shape from the entrance to the nip portion to the center of the nip portion and is flat from the center of the nip portion to the exit of the nip portion.
Figure 8:
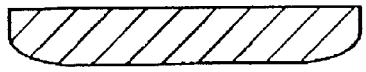
Figure 8:
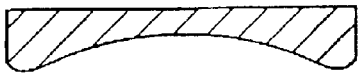
Figure 8:
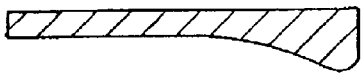

Furthermore, flat plate-shaped ceramic heaters were formed in a manner similar to the above, and similarly, while a fixing film was pressed between the ceramic heaters and a pressure roller and the fixing film was made to travel at a rate corresponding to 40 ppm, the deformed shape of the fixing film and a condition of contact of the fixing film to the ceramic heaters in this traveling state were confirmed, and in order to prevent the fixing film from coming into contact with the ceramic heaters, the edge portions of the ceramic heaters were polished so as to curve smoothly. The fixing face shape of the ceramic heaters at this tine was, as shown in FIG. 8(*a*), a roughly arc-shaped curved surface having a radius R=50 mm, which formed a convex shape with respect to the pressure roller. In addition, the same experiment as in the above was performed by means of stainless steel and nickel fixing films, and as a result, the shape of the fixing face of the ceramic heaters at this time was an arc-shaped curved surface having a radius R=45 mm, which similarly formed a convex shape with respect to the pressure roller.

Thereafter, heater supports were fabricated with a heat-resistant resin so as to have a shape along the deformed shape of each fixing film respectively in a static state and a traveling state wherein the ceramic heaters fabricated as described above were pressed. The ceramic heaters having the above shapes were attached to the fabricated heater supports without creating steps, respectively, and furthermore, fixing films and pressure rollers were attached thereon, thus providing heating-type toner-fixing units.

By means of these heating-type toner-fixing units, first, an unfixed toner image carried on an A4-size sheet of paper was fixed at a rate corresponding to 40 ppm. Then, after idling for a time corresponding to that for printing 200 thousand sheets of paper, toner-fixing similar to the first was performed again. As a result, in all of the sample materials using the ceramic heater of silicon nitride or aluminum nitride and the fixing film of a heat-resistant resin or a metal, satisfactory fixing quality equal to that of the initial first sheet of paper was obtained. These results are collectively shown in Table I below.

The fixing quality shown in Table I was evaluated by scraping the fixed toner with paper and is represented as follows ◎: The toner showed virtually no falling-off, demonstrating an excellent fixing condition.

○: The toner showed slight falling-off, demonstrating a condition with no problems for practical application Δ: The toner showed slight falling-off, demonstrating a condition that cannot be used for practical application.

×: A condition where virtually no toner was fixed (the same applies to the following).

TABLE I

| Sample | Fixing film | Heater material | Shape of heater fixing face | Film orbit | Fixing quality |
|---|---|---|---|---|---|
| 1 | Heat-resistant resin | $Si_3N_4$ | An arc shape R = 50 mm | Static orbit | ○ |
| 2 | Heat-resistant resin | AlN | An arc shape R = 50 mm | Static orbit | ○ |
| 3 | Stainless steel | $Si_3N_4$ | An arc shape R = 45 mm | Static orbit | ◎ |
| 4 | Stainless steel | AlN | An arc shape R = 45 mm | Static orbit | ◎ |
| 5 | Nickel | $Si_3N_4$ | An arc shape R = 45 mm | Static orbit | ◎ |
| 6 | Nickel | AlN | An arc shape R = 45 mm | Static orbit | ◎ |
| 7 | Heat-resistant resin | $Si_3N_4$ | An arc shape R = 50 mm | Travel orbit | ○ |
| 8 | Heat-resistant resin | AlN | An arc shape R = 50 mm | Travel orbit | ○ |
| 9 | Stainless steel | $Si_3N_4$ | An arc shape R = 45 mm | Travel orbit | ◎ |
| 10 | Stainless steel | AlN | An arc shape R = 45 mm | Travel orbit | ◎ |
| 11 | Nickel | $Si_3N_4$ | An arc shape R = 45 mm | Travel orbit | ◎ |
| 12 | Nickel | AlN | An arc shape R = 45 mm | Travel orbit | ◎ |

EXAMPLE 2

Flat plate-shaped ceramic heaters formed of aluminum nitride and silicon nitride were fabricated in the same manner as in Example 1. As shown in FIG. 8(*b*), while the nip portion having a desirable nip width of 7 mm and adjacent portions having a width of 7 mm at the entrance side and the exit side of the nip portion were kept flat on the fixing face of each ceramic heater, both end portions at the entrance side and the exit side other than the flat portions were polished into a curved surface shape along the cylindrical shape of the fixing film so as to prevent the fixing film in a static state or a traveling state from being abraded at the edge portions.

Then, heater supports having a shape along the curved surface shape on both end portions of the respective ceramic heaters were fabricated with a heat-resistant resin, respectively. The ceramic heaters having the above shapes were attached to the fabricated heater supports without creating steps, respectively, and furthermore, fixing films and pressure rollers were attached thereon, thus providing heating-type toner-fixing units.

These heating-type toner-fixing units were evaluated in terms of durability and fixing quality by means of a heat-resistant resin film and a metal film as fixing films in a manner similar to Example 1 As a result, in all sample materials using the ceramic heater of silicon nitride or aluminum nitride and the fixing film of a heat-resistant resin or a metal (the material combination for the ceramic heater and heater support is identical to Example 1), even after idling for a time corresponding to that for printing 200 thousand sheets of A4-size paper, the toner showed virtually no falling-off and excellent fixing quality (evaluation ◎) was obtained

EXAMPLE 3

In the same manner as in Example 1, flat plate shaped ceramic heaters formed of aluminum nitride and silicon nitride were fabricated. Furthermore, as shown in FIG. 8(*c*), the fixing face of the respective ceramic heaters was formed into a curved shape greater than the pressure roller, which is concave with respect to the pressure roller. At this time, the radius of the concave curved surface is provided as R=40 in the case where a heat-resistant resin film was used as a fixing film, and as R=45 mm, in the case where a metal film was used.

Then, this ceramic heater was pressed against the pressure roller with a fixing film sandwiched therebetween, whereby a heater support along the deformed condition of the fixing film in a static state was fabricated. Also, simultaneously, a heater support along the deformed shape of the fixing film in a traveling state was also formed. The ceramic heaters having the above shapes were attached to the fabricated heater supports without creating steps, respectively, and furthermore, fixing films and pressure rollers were attached thereon, thus providing heating-type toner-fixing units.

These heating-type toner-fixing units were evaluated in terms of durability and fixing quality in a manner similar to Example 1, using a heat-resistant resin film and a metal film as fixing films. As a result, in all sample materials using the ceramic heater of silicon nitride or aluminum nitride and the fixing film of a heat-resistant resin or a metal (the material combination for the ceramic heater and heater support is identical to Example 1), even after idling for a time corresponding to that for printing 200 thousand sheets of A4-size paper, the toner showed virtually no falling-off and excellent fixing quality (evaluation ◎) was obtained. However, some of the fixed sheets of paper resulted in curls that would cause no problem for practical application.

EXAMPLE 4

In the same manner as in Example 1, flat plate-shaped ceramic heaters formed of aluminum nitride and silicon nitride were fabricated. Furthermore, similarly to Example 3, the fixing face of the respective ceramic heaters was formed into a curved shape greater than the pressure roller, which is concave with respect to the pressure roller. However, the portion from the center of the nip portion to the exit of the nip portion was formed into a flat shape as shown in FIG. 8(*d*). The radius of a concave curved surface portion from the entrance of the nip portion to the center of the nip portion was provided as R=40 in the case where a heat-resistant resin film was used as a fixing film, and as R=45 mm, in the case where a metal film was used.

Then, this ceramic heater was pressed against the pressure roller with a fixing film sandwiched therebetween, whereby heater supports along the deformed condition of the fixing film in a static state and a traveling state were fabricated, respectively. The ceramic heaters having the above shapes were attached to the fabricated heater supports without creating steps, respectively, and furthermore, fixing films and pressure rollers were attached thereto, thus providing heating-type toner-fixing units.

These heating-type toner-fixing units were are evaluated in terms of durability and fixing quality in a manner similar to Example 1, using a heat-resistant resin film and a metal film as fixing films. As a result, in all sample materials using the ceramic heater of silicon nitride or aluminum nitride and the fixing film of a heat-resistant resin or a metal (the material combination for the ceramic heater and heater support is identical to Example 1), even after idling for a time corresponding to that for printing 200 thousand sheets of A4-size paper, the toner showed virtually no falling-off and excellent fixing quality (evaluation ◎) was obtained. Moreover, the fixed sheets of paper resulted in no curls.

COMPARATIVE EXAMPLES

As ceramic heaters, ceramic heaters of Example 1 each of which was made of silicon nitride or aluminum nitride, whose fixing face has an arc-shaped curved surface having a radius R=50 mm, which is convex with respect to a pressure roller, were fabricated. On the other hand, as heater supporters, heater supporters having a conventionally-employed shape were used.

The ceramic heaters were attached to these heater supports having a conventional shape, and furthermore, a fixing film made from a heat-resistant resin film and a heating roller were attached thereto, respectively; thus heating-type toner-fixing units were fabricated. These heating-type toner-fixing units were evaluated in terms of durability and fixing quality in a manner similar to Example 1, and the results are shown in Table II below.

As a result, in terms of the sample of each comparative example using the heater support having a conventional shape, even with the ceramic heater having a shape similar to Example 1, revolution of the fixing film stopped in a time corresponding to 50 thousand fixed sheets. A fixing test was tried in this condition; however, since the fixing film did not revolve, a fixing test could not be carried out. Thereafter, the power supply of the heater was turned off and after cooling, the fixing film was checked. As a result, it was found that the inner circumferential portion was significantly abraded and abraded scourings therefrom accumulated in front of and in back of the nip portion, thereby hindering the fixing film from traveling.

Moreover, ceramic heaters having a shape of the fixing face of an arc-shaped curved surface shown in FIG. 8(*a*) were fabricated, which are similar to Example 1 except that the material is alumina. Herein, the radius of the arc-shaped curved surface is provided as R=50 mm in the case where the fixing film is a heat-resistant film, and as R=45 mm in the case of a metal film. In addition, as in the case of Example 1, heater supports having a shape along the deformed shape of the fixing film in a traveling state where the above ceramic heater was pressed against the fixing film were fabricated and used.

The ceramic heaters were attached to these heater supports, and furthermore, a fixing film made of a heat-resistant resin film or metal film and a heating roller were attached thereto, and thus heating-type toner-fixing units were fabricated. These heating-type toner-fixing units were evaluated in terms of durability and fixing quality in a manner similar to Example 1. As a result, in the case of samples of the respective comparative examples using alumina as the heater material, irrespective of the shape of the ceramic heater and heater support or the material of the fixing film, the heater was broken due to thermal shock during a rise in temperature. The results of these comparative examples are collectively shown in Table II below.

TABLE II

| Sample | Fixing film | Heater material | Shape of heater fixing face | Film orbit | Fixing quality |
|---|---|---|---|---|---|
| 13 | Heat-resistant resin | $Si_3N_4$ | An arc shape R = 50 mm | Conventional orbit | Δ |
| 14 | Heat-resistant resin | AlN | An arc shape R = 50 mm | Conventional orbit | Δ |
| 15 | Heat-resistant resin | $Al_2O_3$ | An arc shape R = 50 mm | Travel orbit | Heater fracture |
| 16 | Stainless steel | $Al_2O_3$ | An arc shape R = 45 mm | Travel orbit | Heater fracture |
| 17 | Nickel | $Al_2O_3$ | An arc shape R = 45 mm | Travel orbit | Heater fracture |

INDUSTRIAL APPLICABILITY

According to the present invention, by forming the ceramic heater and heater support into a form along the naturally deformed shape of the fixing film, the inner circumferential surface of the fixing film is prevented from coming into contact with the ceramic heater and heater support thereof locally and intensively and being abraded, whereby durability of the fixing film can still further be improved and the heating-type toner-fixing unit having a further improved fixing quality can be provided.

What is claimed is:

1. A heating-type toner-fixing unit in which a cylindrical heat-resistant fixing film is pressed against a heating member by means of a pressure member to form a nip portion between said fixing film and heating member and fixing is carried out by heating a recording material carrying an unfixed toner image while nipping and feeding the recording material, wherein the shape of the fixing face-side surface of a ceramic heater as said heating member which comes into contact with the fixing film and the shape of portions of a heater support at least adjacent to said fixing face-side surface are formed into a shape that is almost identical to a naturally deformed shape of the fixing film in a static state where the fixing film is pressed against the heating member by the pressure member at a designated nip width.

2. A heating-type toner-fixing unit according to claim 1, wherein the shape of the fixing face-side surface of said ceramic heater which comes into contact with a fixing film of said ceramic heater and the shape of portions of said heater support at least adjacent to the fixing face-side surface are formed into a shape having a curved surface that is generally convex or concave with respect to said pressure member.

3. A heating-type toner-fixing unit according to claim 2, wherein the shape of the fixing face-side surface of said ceramic heater which comes into contact with a fixing film and the shape of portions of said heater support at least adjacent to the fixing face-side surface are, from the entrance of the nip portion to the center of the nip portion, formed into a shape which is almost identical to a naturally deformed shape of the fixing film in a static state where the fixing film is pressed against the heating member by the pressure member and, from the center of the nip portion to the exit of the nip portion, are formed into a flat shape.

4. A heating-type toner-fixing unit according to claim 3, wherein the main constituent of the ceramic heater is aluminum nitride or silicon nitride.

5. A heating-type toner-fixing unit according to claim 2, wherein the main constituent of the ceramic heater is aluminum nitride or silicon nitride.

6. A heating-type toner-fixing unit according to claim 1, wherein the shape of the fixing face-side surface of said ceramic heater which comes into contact with a fixing film and the shape of portions of said heater support at least adjacent to the fixing face-side surface are, from the entrance of the nip portion to the center of the nip portion, formed into a shape which is almost identical to a naturally deformed shape of the fixing film in a static state where the fixing film is pressed against the heating member by the pressure member and, from the center of the nip portion to the exit of the nip portion, are formed into a flat shape.

7. A heating-type toner-fixing unit according to claim 6, wherein the main constituent of the ceramic heater is aluminum nitride or silicon nitride.

8. A heating-type toner-fixing unit according to claim 1, wherein the main constituent of the ceramic heater is aluminum nitride or silicon nitride.

9. A heating-type toner-fixing unit in which a cylindrical heat-resistant fixing film is pressed against a heating member by means of a pressure member to form a nip portion between said fixing film and heating member and fixing is carried out by heating a recording material carrying an unfixed toner image while nipping and feeding the recording material, wherein the shape of the fixing face-side surface of a ceramic heater as said heating member which comes into contact with the fixing film and the shape of portions of a heater support at least adjacent to said fixing face-side surface are formed into a shape that is almost identical to a naturally deformed shape of the fixing film in a traveling state where the fixing film is pressed against the heating member by the pressure member at a designated nip width so as to travel.

10. A heating-type toner-fixing unit according to claim 9, wherein the main constituent of the ceramic heater is aluminum nitride or silicon nitride.

11. A heating-type toner-fixing unit according to claim 9 wherein the shape of the fixing face-side surface of said ceramic heater which comes into contact with a fixing film of said ceramic heater and the shape of portions of said heater support at least adjacent to the fixing face-side surface are formed into a curved surface which is generally convex or concave with respect to said pressure member.

12. A heating-type toner-fixing unit according to claim 11, wherein the main constituent of the ceramic heater is aluminum nitride or silicon nitride.

13. A heating-type toner-fixing unit according to claim 11, wherein the shape of the fixing face-side surface of said ceramic heater which comes into contact with a fixing film of said ceramic heater and the shape of portions of said heater support at least adjacent to the fixing face-side surface are, from the entrance of the nip portion to the center of the nip portion, formed into a shape which is almost identical to a naturally deformed shape of the fixing film in a traveling state where the fixing film is pressed against the heating member by the pressure member so as to travel, and from the center of the nip portion to the exit of the nip portion, formed into a flat shape.

14. A heating-type toner-fixing unit according to claim 13, wherein the main constituent of the ceramic heater is aluminum nitride or silicon nitride.

15. A heating-type toner-fixing unit according to claim 9, wherein the shape of the fixing face-side surface of said ceramic heater which comes into contact with a fixing film of said ceramic heater and the shape of portions of said heater support at least adjacent to the fixing face-side surface are, from the entrance of the nip portion to the center of the nip portion, formed into a shape which is almost identical to a naturally deformed shape of the fixing film in a traveling state where the fixing film is pressed against the heating member by the pressure member so as to travel, and from the center of the nip portion to the exit of the nip portion, formed into a flat shape.

16. A heating-type toner-fixing unit according to claim 15, wherein the main constituent of the ceramic heater is aluminum nitride or silicon nitride.

17. A heating-type toner-fixing unit in which a cylindrical heat-resistant fixing film is pressed against a heating member by means of a pressure member to form a nip portion between said fixing film and heating member and fixing is carried out by heating a recording material carrying an unfixed toner image while nipping and feeding the recording material, wherein the shape of the fixing face-side surface of a ceramic heater as said heating member which comes into contact with the fixing film and the shape of portions of a heater support at least adjacent to said fixing face-side surface are, at the nip portion and at the entrance side and exit side adjacent to the nip portion, formed into a flat shape parallel to the nip portion, and at other portions, formed into a shape along the cylindrical shape of said fixing film.

18. A heating-type toner-fixing unit according to claim 17, wherein the main constituent of the ceramic heater is aluminum nitride or silicon nitride.

* * * * *